US006977008B2

(12) United States Patent
Nikkhah

(10) Patent No.: US 6,977,008 B2
(45) **Date of Patent: *Dec. 20, 2005**

(54) CLEANING MECHANISM FOR ION EMITTING AIR CONDITIONING DEVICE

(75) Inventor: Ali Nikkhah, Mission Viejo, CA (US)

(73) Assignee: Sylmark Holdings Limited, (IE)

( * ) Notice: Subject to any disclaimer, the term of this patent is extended or adjusted under 35 U.S.C. 154(b) by 0 days.

This patent is subject to a terminal disclaimer.

(21) Appl. No.: 10/979,825

(22) Filed: Nov. 1, 2004

(65) Prior Publication Data

US 2005/0223898 A1 Oct. 13, 2005

Related U.S. Application Data

(63) Continuation of application No. 10/823,040, filed on Apr. 12, 2004, now Pat. No. 6,855,190.

(51) Int. Cl.[7] ..... B03C 3/74
(52) U.S. Cl. ..... 95/74; 95/76; 96/51; 96/96
(58) Field of Search ..... 95/74, 75; 96/51, 96/96; 422/186.04

(56) References Cited

U.S. PATENT DOCUMENTS

| | | | |
|---|---|---|---|
| 1,869,335 | A | 7/1932 | Day |
| 2,252,694 | A | 8/1941 | Bennett |
| 2,279,583 | A | 4/1942 | Slayter |
| 3,540,191 | A | 11/1970 | Herman |
| 4,227,894 | A | 10/1980 | Proynoff |
| 4,231,766 | A | 11/1980 | Spurgin |
| 4,284,420 | A | 8/1981 | Borysiak |
| 4,318,718 | A | 3/1982 | Utsumi et al. |
| 4,689,056 | A | 8/1987 | Noguchi et al. |
| 4,789,801 | A | 12/1988 | Lee |
| 6,163,098 | A | 12/2000 | Taylor et al. |
| 6,312,507 | B1 | 11/2001 | Taylor et al. |
| 6,348,103 | B1 | 2/2002 | Ahlborn et al. |
| 6,350,417 | B1 | 2/2002 | Lau et al. |
| 6,544,485 | B1 | 4/2003 | Taylor |
| 6,632,407 | B1 | 10/2003 | Lau et al. |
| 6,635,105 | B2 | 10/2003 | Ahlborn et al. |
| 6,709,484 | B2 | 3/2004 | Lau et al. |
| 6,713,026 | B2 | 3/2004 | Taylor et al. |
| 6,749,667 | B2 | 6/2004 | Reeves et al. |
| 6,824,587 | B2 * | 11/2004 | Mohamed ..... 95/7 |
| 6,855,190 | B1 * | 2/2005 | Nikkhah ..... 96/51 |
| 6,908,501 | B2 * | 6/2005 | Reeves et al. ..... 96/29 |
| 2001/0032544 | A1 | 10/2001 | Taylor et al. |
| 2001/0048906 | A1 | 12/2001 | Lau et al. |
| 2002/0079212 | A1 | 6/2002 | Taylor et al. |
| 2002/0098130 | A1 | 7/2002 | Fong |
| 2002/0098131 | A1 | 7/2002 | Taylor et al. |
| 2002/0122751 | A1 | 9/2002 | Sinaiko et al. |
| 2002/0122752 | A1 | 9/2002 | Taylor et al. |
| 2002/0127156 | A1 | 9/2002 | Taylor |
| 2002/0134664 | A1 | 9/2002 | Taylor et al. |
| 2002/0134665 | A1 | 9/2002 | Taylor et al. |

(Continued)

*Primary Examiner*—Richard L. Chiesa
(74) *Attorney, Agent, or Firm*—Kathy Mojibi Kavcioglu

(57) ABSTRACT

A cleaning mechanism for a wire electrode of an air purifier device includes a base, a post having a first end attached to the base and a second end accessible from a location external the housing, a cleaning plate assembly attached to the base, wherein the cleaning plate assembly frictionally contacts the wire electrode when moved relative to the wire electrode. The cleaning plate assembly is movable within the housing when the second end of the post is moved from a resting configuration to a cleaning configuration.

15 Claims, 5 Drawing Sheets

U.S. PATENT DOCUMENTS

2002/0146356 A1 10/2002 Sinaiko et al.
2002/0150520 A1 10/2002 Taylor et al.
2002/0155041 A1 10/2002 McKinney, Jr. et al.
2003/0072697 A1 4/2003 Taylor
2003/0147783 A1 8/2003 Taylor
2003/0147785 A1 8/2003 Joannou
2003/0147786 A1 8/2003 Taylor
2003/0159918 A1 8/2003 Taylor
2003/0165410 A1 9/2003 Taylor
2003/0170150 A1 9/2003 Lau et al.
2003/0206837 A1 11/2003 Taylor et al.
2003/0206839 A1 11/2003 Taylor et al.
2003/0206840 A1 11/2003 Taylor et al.
2003/0209420 A1 11/2003 Taylor et al.
2003/0233935 A1 12/2003 Reeves et al.
2004/0003721 A1 1/2004 Lau et al.
2004/0018126 A1 1/2004 Lau et al.
2004/0033176 A1 2/2004 Lee et al.
2004/0033340 A1 2/2004 Lau et al.
2004/0047775 A1 3/2004 Lau et al.
2004/0052700 A1 3/2004 Kotlvar et al.
2004/0057882 A1 3/2004 Lau et al.
2004/0079233 A1 4/2004 Lau et al.
2004/0096376 A1 5/2004 Taylor et al.

* cited by examiner

CLEANING MECHANISM FOR ION EMITTING AIR CONDITIONING DEVICE

This application is a continuation of Ser. No. 10/823,040, filed on Apr. 12, 2004, and now U.S. Pat. No. 6,855,190.

FIELD OF INVENTION

The present invention relates generally to electrostatic air conditioning devices and more particularly to a mechanism for cleaning the wire electrodes in such devices.

BACKGROUND OF THE INVENTION

Electrostatic air cleaners use electric energy to generate electrostatic forces which create air flow without the use of a fan or other moving parts. Electrostatic forces also enable the air cleaner to collect airborne contaminants such as dust, smoke, oil mist, pollen, pet dander and other small debris particles from the air circulated in dwellings, workplaces, and other structures. Generally, known electrostatic air cleaners utilize two arrays of electrodes excited by high-voltage. In a known design, the first electrode array comprises wire or rod-shaped electrodes (hereinafter "wire electrodes"), while the second electrode array comprises plate electrodes. A high-voltage generator creates an electrical charge between the first and second electrode arrays.

The particulate matter enters the region of the first electrode array and is charged before entering the region of the second electrode array, where it is removed from the air stream. Specifically, due to the high-voltage charge at the wire electrodes, free electrons are stripped off of atoms and molecules in the surrounding air. These electrons migrate to the positively charged wire electrodes, where they are collected. The removal of free electrons leaves the stripped atoms and molecules positively charged, which are repelled from the positively charged wire electrodes and attracted to the negatively charged plate electrodes. The addition of the electrons from the negatively charged plate electrodes also produces negative air ions that are propelled from the trailing edge of the plate electrodes. Thus, the ionic forces exerted on atoms and molecules create a silent movement of air through the air cleaner.

Because collected and adhered debris greatly reduces a wire electrode's efficiency and effectiveness, the debris must be periodically removed. In the past, the cleaning of the wire electrodes of the electrostatic air cleaners has been difficult because of the close spacing of the electrode arrays and the high voltages applied to the closely spaced, oppositely charged arrays. Care must be exercised to see that the electrode assemblies are cleaned effectively and are not electrically shorted together or to a ground. For this reason, some devices require periodic shut-down and disassembly so that the wire electrodes can be removed for washing. Other devices are rappers or shakers which strike or vibrate the wire electrode assemblies to loosen collected debris and cause it to fall from the electrode assemblies.

Another known method of cleaning the wire electrodes is to thread the wire electrode through a bead. The bead is dimensioned to remain in frictional contact with the wire electrode and remove debris as it travels the length of the electrode. To cause the bead to travel along the length of electrode, the air cleaner is rotated and gravity causes the bead to travel from an initial position along the electrode and frictionally remove contaminates from the outer surface of the electrode. The air cleaner is then returned to its original position and the bead returns to its initial position along the electrode. To maintain the efficiency of the air cleaner, the air cleaner may need to be rotated multiple times to further clean the electrode.

A disadvantage of this type of cleaning is that the air cleaner could be heavy and bulky, and it may be inconvenient for users to lift and rotate a heavy and bulky air cleaner. Furthermore, in the process of lifting and rotating the air cleaner, the user could drop the cleaner and cause damage to the device. Also, when a user lifts and rotates the air cleaner, the debris that is removed from the electrode is likely to contaminate the user.

It is therefore desirable to provide a cleaning mechanism for a wire electrode assembly that is convenient, easy to use and does not require the lifting or rotating of a heavy, bulky air cleaner apparatus.

SUMMARY OF PREFERRED EMBODIMENTS

A cleaning mechanism for a wire electrode of an air purifier device includes a base, a post having a first end attached to the base and a second end accessible from a location external the housing, a cleaning plate assembly attached to the base, wherein the cleaning plate assembly frictionally contacts the wire electrode when moved relative to the wire electrode. The cleaning plate assembly is movable within the housing when the second end of the post is moved from a resting configuration to a cleaning configuration.

DETAILED DESCRIPTION OF PREFERRED EMBODIMENTS

Figure 1:
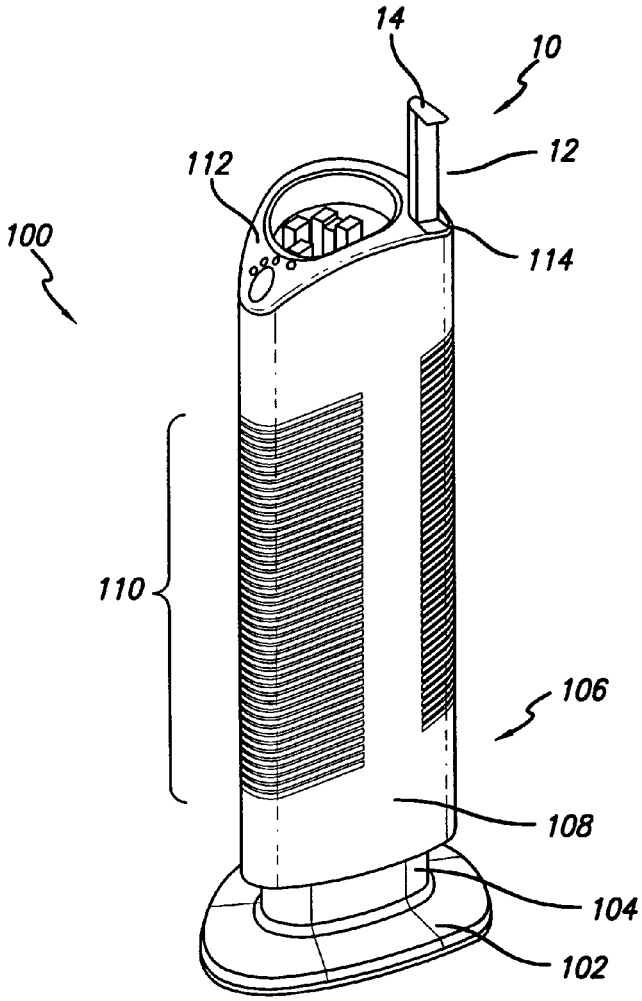
FIG. 1 is a perspective view of a preferred embodiment of an air purifier device with the cleaning mechanism of the present invention.

FIG. 1 depicts a preferred embodiment of the cleaning mechanism 10 of the present invention as installed in an air purifier apparatus 100. The air purifier apparatus 100 includes a base 102, a pedestal 104 and a housing 106. In the embodiment shown in FIG. 1, the housing 106 is wedge-shaped and has a plurality of side surfaces 108. Vents 110 are provided on the side surfaces 108 to facilitate the circulation of an air stream through the air purifier apparatus 100. It should be noted that the present invention is not limited to a wedge-shaped housing; rather, it is envisioned that the air purifier housing can be of any shape, including, oval, circular, rectangular or any other shape.

The cleaning mechanism 10 of the present invention is preferably accessible from the outside of the air purifier apparatus 100. Specifically, the upper surface 112 of the housing 106 defines an aperture 114 therein through which extends the post 12 of a preferred embodiment of the cleaning mechanism 10. As discussed in greater detail below, to clean the wire electrodes of the air purifier apparatus 100, the cleaning mechanism 10 of the present invention is moved up and down in a plunging fashion. To actuate the cleaning mechanism 10, the user preferably grasps the control knob 14 and lifts the knob 14 away from the upper surface 112 of the housing 106, thereby withdrawing the post 12 from the housing 106, and then pushing the post 12 back into the housing 106 and returning the knob 14 to its original position on the upper surface 112 of the housing 106. For ease of reference, the movement of the cleaning mechanism 10 described herein is referred to as a plunging movement. Although control knob 14 is described as extending out of the upper surface 112 of the housing 106, it is envisioned that control knob 14 can be configured to extend from any surface of the housing 106. By way of example, the housing 106 can include a slot (not shown) on a side surface 108 thereof and the control knob 14 can extend through the slot on the side surface 108 of the housing 106.

Figure 2:
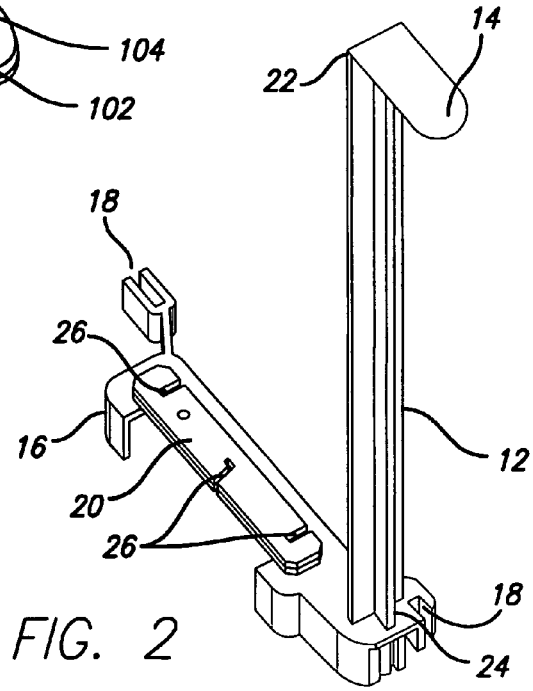
FIG. 2 is a perspective view of a preferred embodiment of the cleaning mechanism of the present invention.

As shown in FIG. 2, a preferred embodiment of the cleaning mechanism 10 of the present invention includes a post 12, a control knob 14, a base 16, guide members 18 and a cleaning plate assembly 20. Post 12 is attached to a control knob 14 at its first end 22 and to the base 16 at its second end 24. The base 16 is dimensioned to carry the post 12 and the cleaning plate assembly 20. To guide the motion of the cleaning mechanism through the housing 106, guide members 18 extend from the base 16, as further described below.

Figure 3:
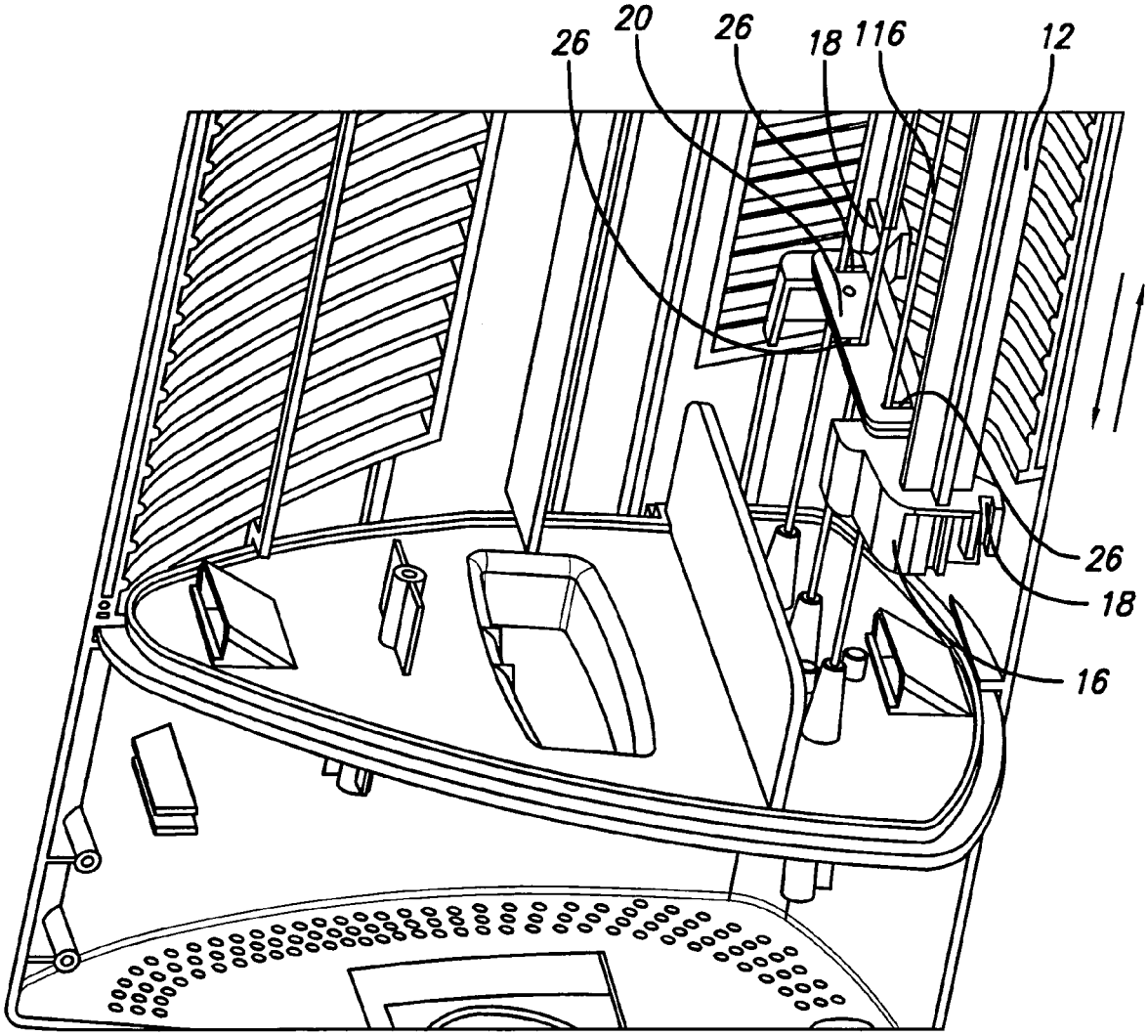
FIG. 3 is a perspective view of a preferred embodiment of the cleaning mechanism of the present invention as installed on a wire electrode array.

The cleaning plate assembly 20 preferably defines a plurality of receiving ports 26 therein, each dimensioned to receive a wire electrode. FIG. 3 depicts a preferred embodiment of the cleaning mechanism 10 of the present invention as installed on the wire electrodes 116 of the air purifier apparatus 100. As shown in FIG. 3, each wire electrode 116 is received in a receiving port 26 of the cleaning plate assembly 20. The cleaning plate assembly 20 is carried on the base 16 in such a manner as to not interfere with the passing of the wire electrodes 116 through the receiving ports 26 of the cleaning plate assembly 20. The receiving ports 26 are dimensioned to frictionally maintain contact with the wire electrodes 116 as the cleaning mechanism 10 is moved up and down along a length of the electrode array. As the cleaning mechanism 10 is actuated, the cleaning plate assembly 20 scrapes the particulates off the wire electrode 116.

The cleaning plate assembly of the present invention is preferably configured for use with all of the wire electrodes of the electrode array. In the embodiment shown in FIG. 3, the electrode array consists of three wire electrodes 116. As such, the cleaning plate assembly 20 has three receiving ports 26, each for receiving one wire electrode 116 of the electrode array. The wire electrodes 116, in FIG. 3, are shown in a collinear relationship. It is envisioned that the cleaning plate 20 of the present invention can be adapted to accommodate wire electrodes that are not collinear. Furthermore, it is within the scope of the present invention to adapt the cleaning mechanism to accommodate less than all of the wire electrodes in an electrode array. Specifically, the cleaning mechanism 20 can be adapted for use with one or more wire electrodes, and more preferably, with at least two wire electrodes.

Figure 4:
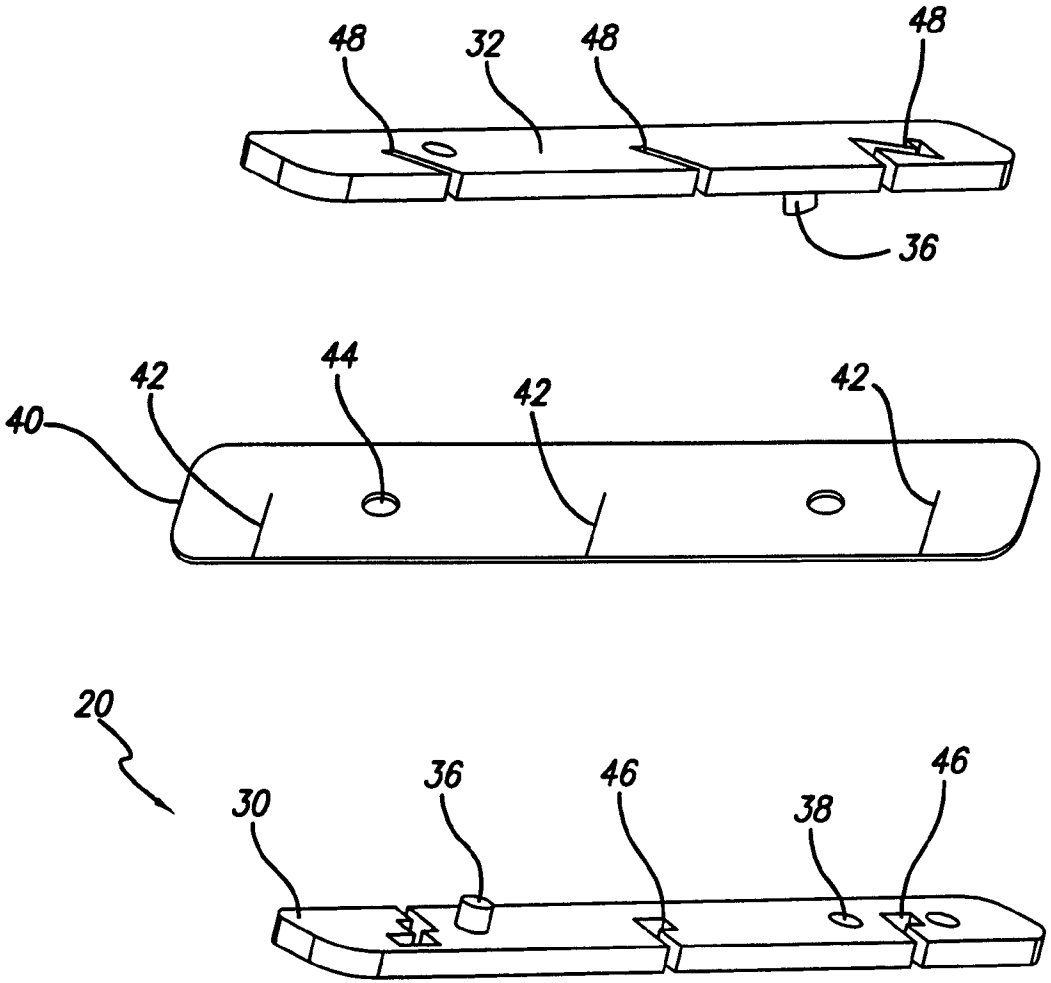
FIG. 4 is an exploded view of a preferred embodiment of the cleaning plate assembly of the present invention.

In a preferred embodiment of the invention, as shown in FIG. 4, the cleaning plate assembly 20 includes a first plate 30 and a second plate 32. The first and second plates 30, 32 are interlockable to form the cleaning plate assembly 20. Corresponding engagement members 34 (shown in FIG. 5) are provided to interlock the first and second plates 30, 32 to each other. In one embodiment of the invention, as shown in FIG. 4, the corresponding engagement members 34 are a locking post 36 integrally attached to and extending from a surface of the first or second plate. The locking post 36 friction fits into a corresponding hole 38 on the other plate. In the embodiment shown in FIG. 4, each of the first and second plates 30, 32 include a locking post 36 and corresponding hole 38 so that the plates can be interlocked at two positions. The engagement members 34 are not limited to those described herein but can include any known device that can engage the first plate 30 with the second plate 32 to form the cleaning plate assembly 20.

In a preferred embodiment of the invention, a thin flexible sheet 40, preferably of Mylar or Kapton type material, is positioned between the first plate 30 and the second plate 32 to enhance the cleaning capacity of the cleaning plate assembly 20. The sheet 40 preferably has high voltage breakdown, high dielectric constant, can withstand high temperature, and is flexible. A slit 42 is cut in the sheet for each wire electrode 116 such that each wire electrode fits into a slit 42 in the sheet. Friction between the inner slit edge surrounding each wire scrapes off any debris coating on the wire electrode. The sheet 40 also defines apertures 44 therein, positioned to allow the engagement members 34 to pass therethrough.

The first plate 30 defines one or more channels 46 therein and the second plate 32 defines one or more channels 48 therein. The first plate 30, second plate 32 and sheet 40 are sandwiched together such that a channel 46 of the first plate 30, a channel 48 of the second plate 32, and a slit 42 of the sheet 40 align with each other. In a preferred embodiment of the invention, the channels 46, 48 and slit 42 together form a receiving port 26 for a wire electrode. In another preferred embodiment of the invention, the sheet 40 can be eliminated, in which case, the channels 46, 48 collectively would form a receiving port for a wire electrode.

Figure 5:
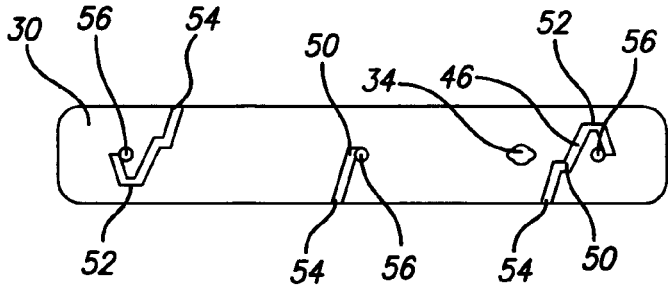
FIG. 5 is a perspective view of a preferred embodiment of a first plate of the cleaning plate assembly.

A preferred embodiment of the invention, as shown in FIG. 5, the channels 46 in the first plate 30 are non-linear in form. Second plate 32 preferably is identical to the first plate 30 and has the shape channels as those shown in FIG. 5. A non-linear channel is better able to retain the wire electrode therein, whereas the wire electrode can more easily slip out of a linear channel. Therefore, in a preferred embodiment of the invention, channels 46 and 48 are non-linear.

As shown in FIG. 5, the non-linear channels can include a bend 50, a u-shaped curve 52, any other non-linear shape or a combination of any of the above. In a preferred embodiment of the invention, each channel includes an entrance 54 and an end 56. To install the wire electrode on a cleaning plate, the wire electrode is inserted through the entrance 54 of the channel, past at least one bend or u-shaped curve, and is preferably positioned at the end 56 of the channel. The channel end 56 is shaped to frictionally engage the wire electrode, thus cleaning debris off of the electrode as the cleaning plate is moved relative to the wire electrode.

Figure 6:
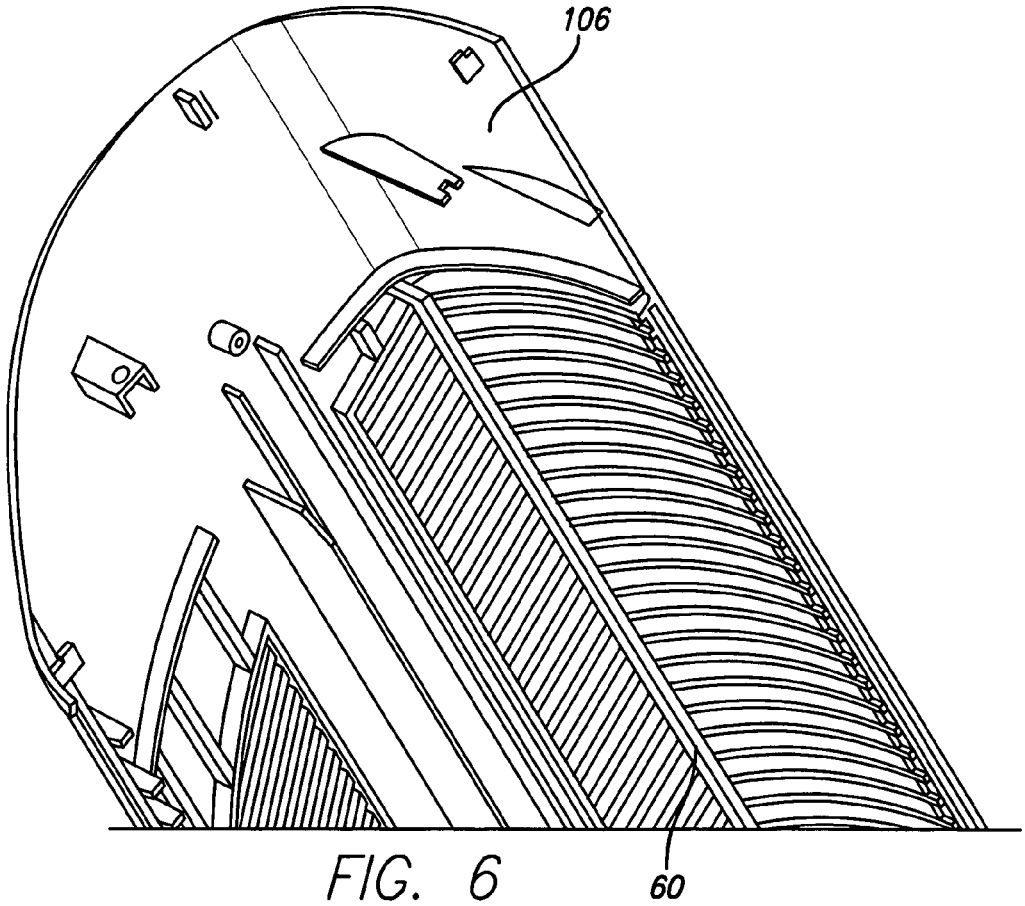
FIG. 6 is a perspective view of a guide rib of an air cleaner in accordance with a preferred embodiment of the present invention.

To facilitate the movement of the cleaning plate assembly 26 inside the housing 106, the housing 106 defines a guide rib 60, as shown in FIG. 6. Guide rib 60 is shaped to engage the guide member 18 (shown in FIG. 2). In a preferred embodiment of the invention, two guide ribs 60 are provided, one for each of the guide members 18 shown in FIG. 2. The engagement of the guide members 18 with the guide ribs 60 assists in ensuring that the cleaning plate assembly 26 moves in a steady, controlled manner with respect to the housing 106. Furthermore, the guide ribs 60 limit the lateral movement of cleaning plate assembly 26 within the housing. Thus, users will be prevented from damaging the wire electrodes by placing excessive lateral forces thereon.

In a preferred embodiment of the invention, the guide rib 60 is a vertical protrusion extending from the inner surface of the housing 106. In addition to guiding the movement of the cleaning plate assembly 26, the guide rib 60 can be configured to provide structural support for the vents 110. Specifically, the guide rib 60 can be attached to the vents 110 such that it will provide additional support to maintain the structural integrity of the housing 106, and the vents 110 specifically, when forces are exerted on the housing 106.

The guide member 18 is shaped to receive the guide rib 60 therein. In the embodiment shown in FIG. 2, the guide members 18 have a rectangular shape to receive a rectangular-shaped guide rib. The invention is not limited to the shape shown herein; rather, the guide ribs 60 and guide members 18 can have any shape as long as the guide rib 60 can engage the guide member 18.

Figure 7:
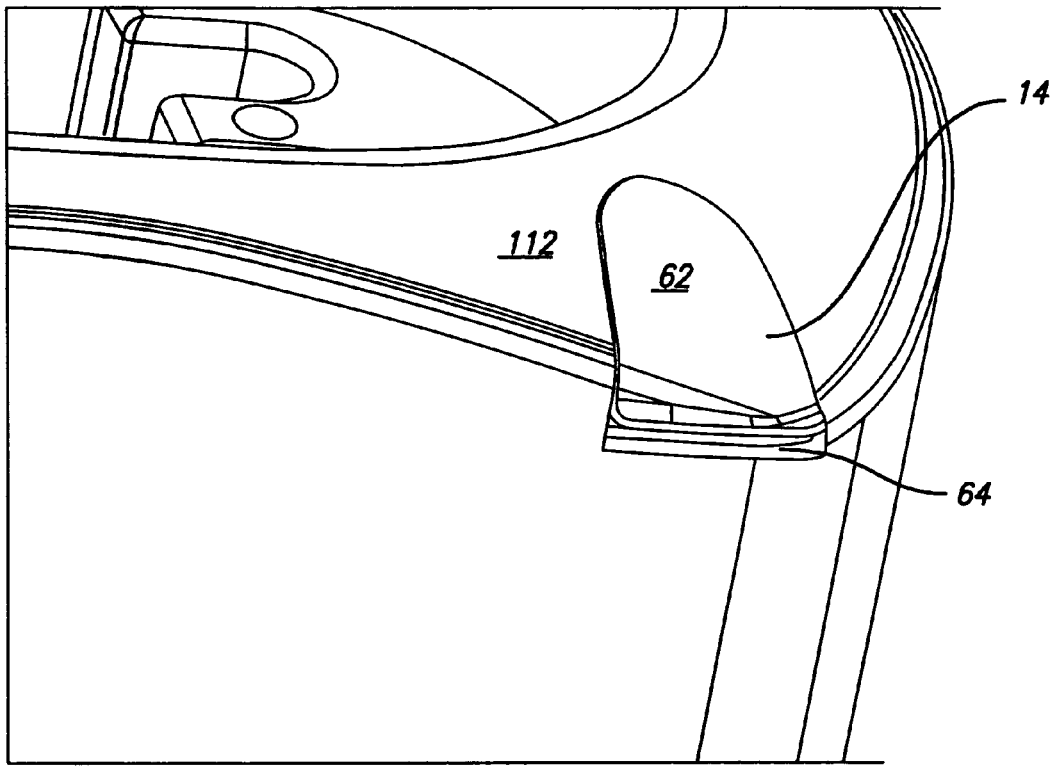
FIG. 7 is a perspective view of a preferred embodiment of the cleaning mechanism knob as installed in an air cleaner of the present invention.

FIG. 7 depicts a preferred embodiment of the cleaning mechanism 10 at its initial, at rest position. In the initial position, the top surface 62 of the control knob 14 is preferably substantially flush with the upper surface 112 of the housing 106. To assist the user in grasping the control knob 14 and lifting it for cleaning, a gap 64 is defined in the housing 106 directly adjacent the control knob 14. To lift the control knob 14, the user can use the gap to position one or more finger under the control knob 14. The control knob 14 is then lifted, pulling the post 12 out of the housing 106, thereby moving the cleaning plate assembly 26 up. The cleaning plate assembly 26 scrapes debris off of the wire electrodes as it moves relative to the electrodes. The cleaning mechanism can be moved up and down several times, in a plunging movement, until the wire electrodes have been cleaned to satisfaction. When finished, the control knob is returned to its rest position, as shown in FIG. 7.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A cleaning mechanism for an air purifier device, the air purifier device having a housing, a wire electrode and a non-wire electrode, the cleaning mechanism comprising:

a base;

a non-electrode post positioned in the housing at a location spaced apart from the non-wire electrode and the wire electrode, the non-electrode post having a first end attached to the base and a second end accessible from a location external the housing, the second end of the post being movable from a resting configuration to a cleaning configuration;

a cleaning plate assembly attached to the base, wherein the cleaning plate assembly frictionally contacts the wire electrode when moved relative to the wire electrode, and wherein the cleaning plate assembly is movable within the housing when the second end of the post is moved from the resting configuration to the cleaning configuration.

2. The cleaning mechanism of claim 1 wherein the post is accessible through an opening in an upper surface of the housing.

3. The cleaning mechanism of claim 1 wherein the post is accessible through an opening in a side surface of the housing.

4. The cleaning mechanism of claim 1 further comprising:

a control knob attached to the second end of the post, wherein the control knob has an upper surface;

wherein in the resting configuration, the upper surface of the control knob is flush with an upper surface of the housing.

5. The cleaning mechanism of claim 1 wherein the cleaning plate assembly comprises a first plate and a second plate, each of the first and second plates defining at least one channel therein.

6. The cleaning mechanism of claim 5 wherein the at least one channel in each of the first and second plates is non-linear.

7. The cleaning mechanism of claim 5 wherein the first and second plates are substantially identical.

8. The cleaning mechanism of claim 5 further comprising a flexible sheet between the first and second plates.

9. The cleaning mechanism of claim 8 wherein the flexible sheet comprises Kapton.

10. A method of cleaning a wire electrode in a housing of an air purifier device, comprising the steps of:

providing an air purifier having a housing, a wire electrode and a non-wire electrode;

providing a cleaning mechanism having a cleaning plate assembly in frictional contact with the wire electrode, a non-electrode post positioned in the housing at a location spaced apart from the wire electrode and the non-wire electrode, the non-electrode post operatively attached to the cleaning mechanism;

actuating the post from a resting configuration to a cleaning configuration thereby moving the cleaning plate assembly relative to the wire electrode.

11. The method of claim 10 wherein the post has a first end attached to the cleaning assembly and a second end accessible from a location external the housing, the method further comprising the step of grasping the second end of the post from the location external the housing.

12. The method of claim 10 wherein the post extends through an opening in an upper surface of the housing.

13. The method of claim 11 wherein the post extends through an opening in a side surface of the housing.

14. The method of claim 10 further comprising the step of scraping debris from the wire electrode as the cleaning plate assembly is moved along a length of the wire electrode.

15. A method of cleaning a wire electrode in a housing of an air purifier device, comprising the steps of:

providing an air purifier having a housing, a wire electrode and a non-wire electrode;

providing a cleaning mechanism having a cleaning plate assembly in frictional contact with the wire electrode, and a non-electrode post operatively attached to the cleaning mechanism, the non-electrode post positioned in the housing at a location spaced apart from the wire electrode and the non-wire electrode, the cleaning plate having a rigid body wherein the rigid body defines at least one channel therein dimensioned to receive the wire electrode, the post having a first end attached to the cleaning plate assembly and a second end defining a control knob, the control knob accessible from a location external the housing;

accessing the control knob from the location external the housing;

actuating the control knob to move the post from a resting configuration to a cleaning configuration thereby moving the cleaning plate assembly relative to the wire electrode; and scraping debris from the wire electrode as the cleaning plate assembly is moved along a length of the wire electrode.

* * * * *